US007713586B2

(12) United States Patent
Luo

(10) Patent No.: US 7,713,586 B2
(45) Date of Patent: May 11, 2010

(54) METHOD FOR A SURFACE BEING PLATED LOCALLY

(75) Inventor: Shi-Ping Luo, Kaohsiung (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 778 days.

(21) Appl. No.: 11/556,744

(22) Filed: Nov. 6, 2006

(65) Prior Publication Data

US 2008/0105559 A1 May 8, 2008

(51) Int. Cl.
*B05D 1/18* (2006.01)
*B05D 1/36* (2006.01)
*B05D 3/12* (2006.01)

(52) U.S. Cl. ..... 427/405; 427/299; 427/327; 427/307; 427/402; 427/430.1; 427/329; 427/406; 427/436; 118/400; 118/423; 118/428

(58) Field of Classification Search ..... 427/430.1; 118/423, 428, 427
See application file for complete search history.

(56) References Cited

U.S. PATENT DOCUMENTS 1,749,953 A * 3/1930 Lichtman ..... 204/297.1
6,706,329 B1 * 3/2004 Chien ..... 427/406

* cited by examiner

*Primary Examiner*—David Turocy

(57) ABSTRACT

A method for a surface being plated locally includes a fixture for holding at least a work piece and the fixture is supported with two opposite lateral walls of a plating tank. Hence, a plated zone on a surface of the work piece can be immerged into the liquid contained in the plating tank for the plated zone being coated with de-oxide layer and plating layer sequentially.

4 Claims, 9 Drawing Sheets

METHOD FOR A SURFACE BEING PLATED LOCALLY

BACKGROUND OF THE INVENTION

1. Field of the Invention

The present invention is related to a method for a surface being plated locally and particularly to a method which is capable of plating a specific plated zone on a surface of a work piece without wasting plating material.

2. Brief Description of the Related Art

The conventional radiator assembly is made of two different materials, such as aluminum alloy and copper, that is, the radiator itself is made of aluminum and a base, which is attached to the radiator, is made of copper. In order to join the radiator and the base together, the joining end of the radiator is plated with a layer of nickel and then adhesive such as soldering paste is coated on the layer of nickel to adhere the base once the adhesive is cool down.

The method for plating the preceding radiator assembly is shown in FIG. 1. The work piece is processed with oil removal and water cleaning sequentially twice first. Then, the work piece is performed with zinc replacement and water cleaning sequentially twice (a step of zinc removal is performed after the first zinc replacement and water cleaning). After that, the work piece is immerged into plating solution completely to allow the surface of the work piece being plated. Once the plating job is finished, the work piece is taken out to be cleaned with water and dried with oven.

However, it is a problem of the conventional method for nickel plating that the entire radiator assembly has to be immerged in the nickel solution for plating the joining ends of the aluminum radiator and the copper base with nickel only. It results in longer plating time and excessively consumed nickel spending on the unnecessary plated area of the work piece such that not only production cost increases but also heat dissipation efficiency of the radiator assembly decreases due to the heat dissipation efficiency of nickel is worse than the materials of the radiator assembly.

SUMMARY OF THE INVENTION

Accordingly, an main object of the present invention is to provide a method for a surface being plated locally with which only a plated zone on a surface is capable of being immerged in the liquid of a plating tank.

Another object of the present invention is to provides a method for a surface being plated locally with which de-oxide solution and plating liquid consume economically.

In order to achieve the preceding object, a method for a surface being plated locally according to the present invention includes a fixture for holding at least a work piece and the fixture is supported with two opposite lateral walls of a plating tank. Hence, a plated zone on a surface of the work piece can be immerged into the liquid contained in the plating tank for the plated zone being coated with de-oxide layer and plating layer sequentially.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

A method for a surface being plated locally according to the present invention including following steps:

A. repeat two times of operations of removing oil on a surface of at least a work piece and washing the surface with water before the work piece being placed in a de-oxide tank for processing the first de-oxide layer;

B. a fixture clamping the work piece is placed on a first plating tank in a way of crossing over the first plating tank and being supported with two opposite sides of the first plating tank to allow part of the surface of the work piece to be immerged into a liquid contained in a first plating tank such that the plated zone on the surface forms uniform strip shaped de-oxide layer. Then, lift the fixture away the first plating tank and wash the work piece with water; and C. the fixture is placed on a second plating tank in a way of crossing over the second plating trough and being supported with two opposite sides of the second plating tank to allow the de-oxide layer on the surface of the work piece to be immerged into another liquid contained in the second plating tank such that a plated layer is formed on the de-oxide layer. Then, lift the fixture away the second plating tank before the work piece is washed with water and dried with oven.

The liquid in the first and second plating tanks is de-oxide solution and plating solution respectively. It can be implemented that the de-oxide solution is zinc solution and the de-oxide layer is a zinc layer coating the plated zone on the surface of the work piece part. Further, the plating liquid is nickel solution so that a nickel plating layer coats the zinc layer.

The work piece can be an integral radiator or a single cooling fin.

Figure 1:
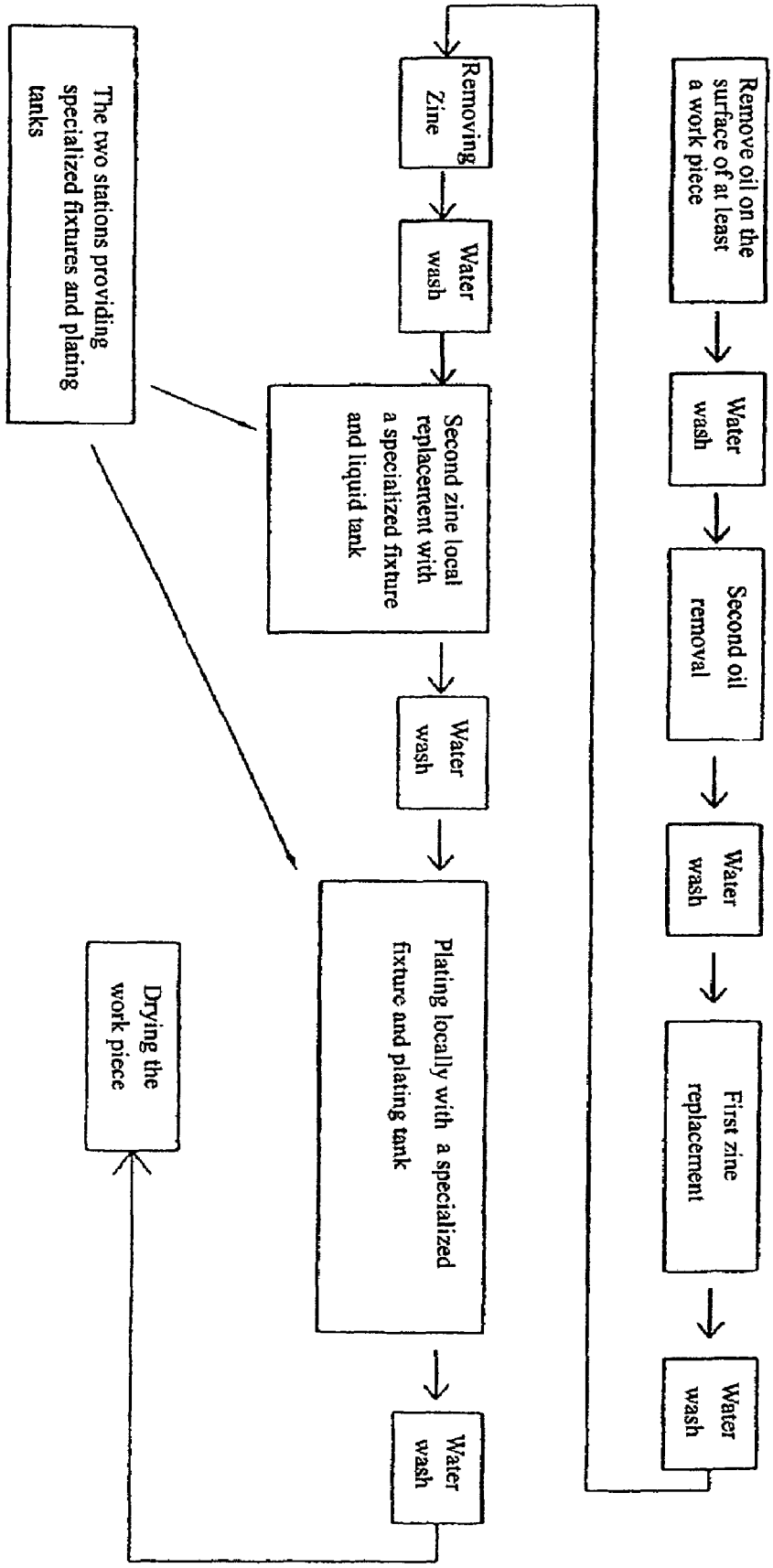
FIG.1(Prior Art)
FIG. 1 is a block diagram illustrating steps of conventional plating.
Figure 2:
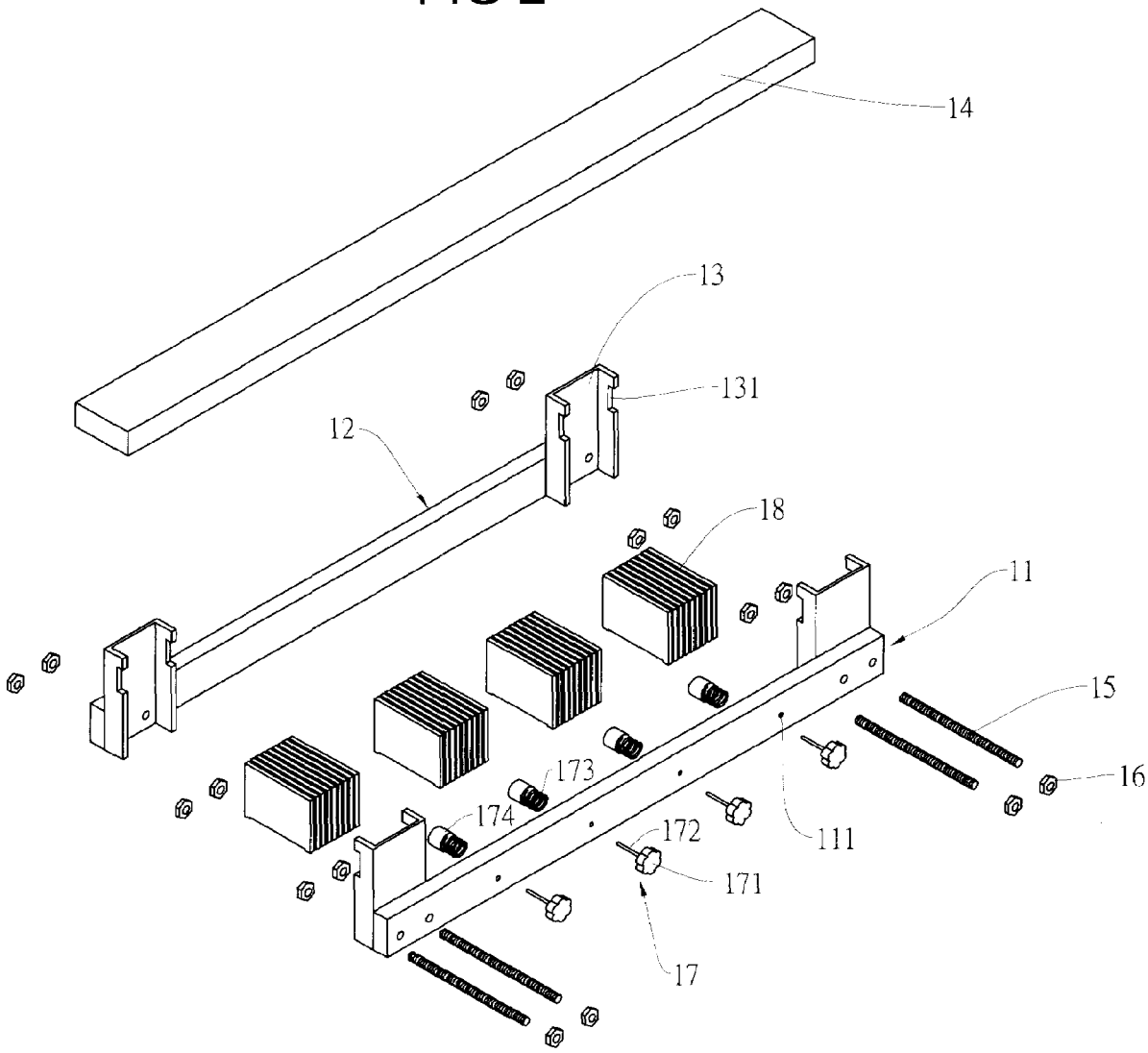
FIG. 2 is an exploded perspective view of a fixture employed in a method for a surface being plated locally according to the present invention.
Figure 3:
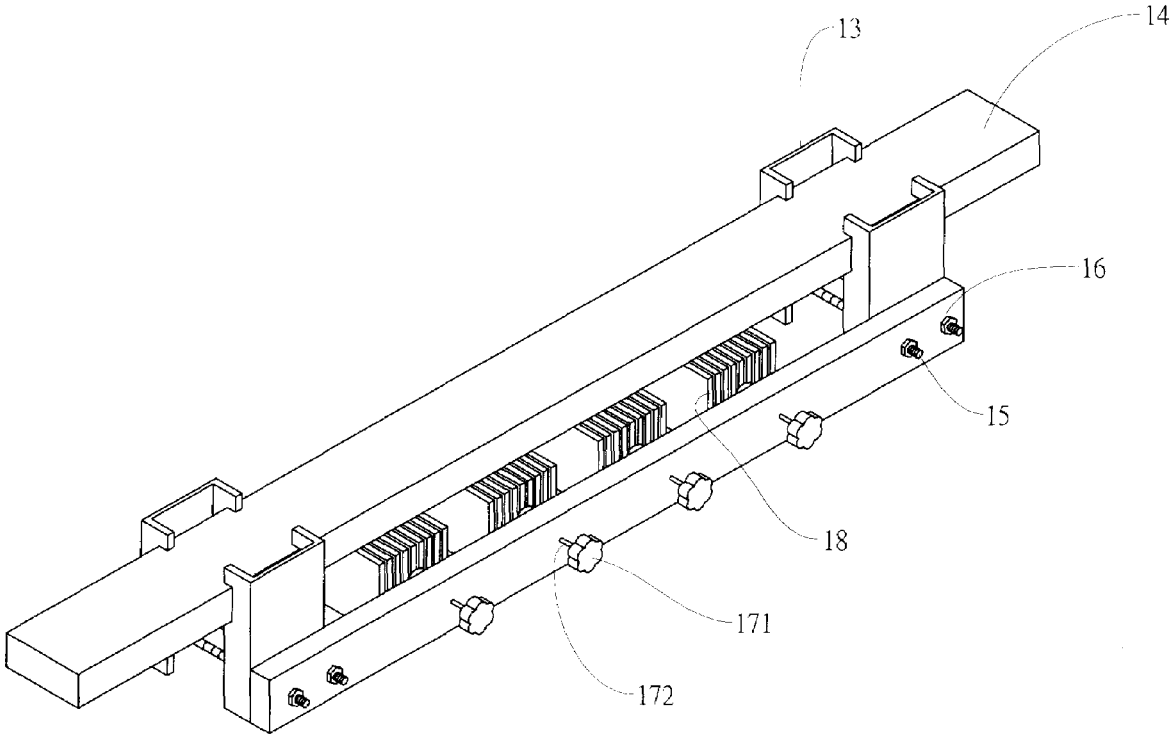
FIG. 3 is an assembled perspective view of the fixture shown in FIG. 2.

Referring to FIGS. 2 and 3, the fixture includes a first main member 11, a second main member 12 corresponding to the first main member 11, a channel shaped hanging arms 13 being attached to both ends of the first main member 11 and the second main member 12 respectively. The hanging arms 13 at the first main member 11 are disposed to be opposite to those at the second main member 12 in a way of the inner sides of the hanging arms 13 at the first main member 11 facing the inner sides of the hanging arms 13 at the second main member 12. The respective hanging arm 13 provides a recess at two opposite lateral sides to catch two lateral sides of a third main member 14. At least a screw rod 15 penetrates the respective hanging arm 13, the first main member 11 and the second main member 12 such that both ends of the screw rod extend outward the first and second main member 11, 12 for a space between the two main members 11, 12 being capable of being adjusted and set with a nut 15 fastening to both ends of the screw rod.

The first main member 11 at least has a threaded hole 111 and a press element 17 corresponds the threaded hole 111. The press element has a knob 171 and a threaded stem 172. The threaded stem 172 engages with the threaded hole 111 and passes through the threaded hole 111. An elastic element 173 surrounds the threaded stem 172 and a touch block 174 connects with an end of the threaded stem 172.

At least a work piece 18, which can be a radiator, is disposed between the first main member 11 and the second main member 12. When the press element 17 is turned with the knob 171 thereof, the threaded stem 172 urges the touch block 174 toward the second main member 12 to press the plated work piece 18. In this way, the work piece 18 is held between the first and second main members 11, 12 temporarily to expose the plated zone of the work piece 18.

The elastic element 173 is capable of adjusting pressure of the touch block 174 against the work piece 18 to prevent the work piece 18 from being hurt with excessive pressure while the threaded stem 172 urging the touch block 174.

Figure 4:
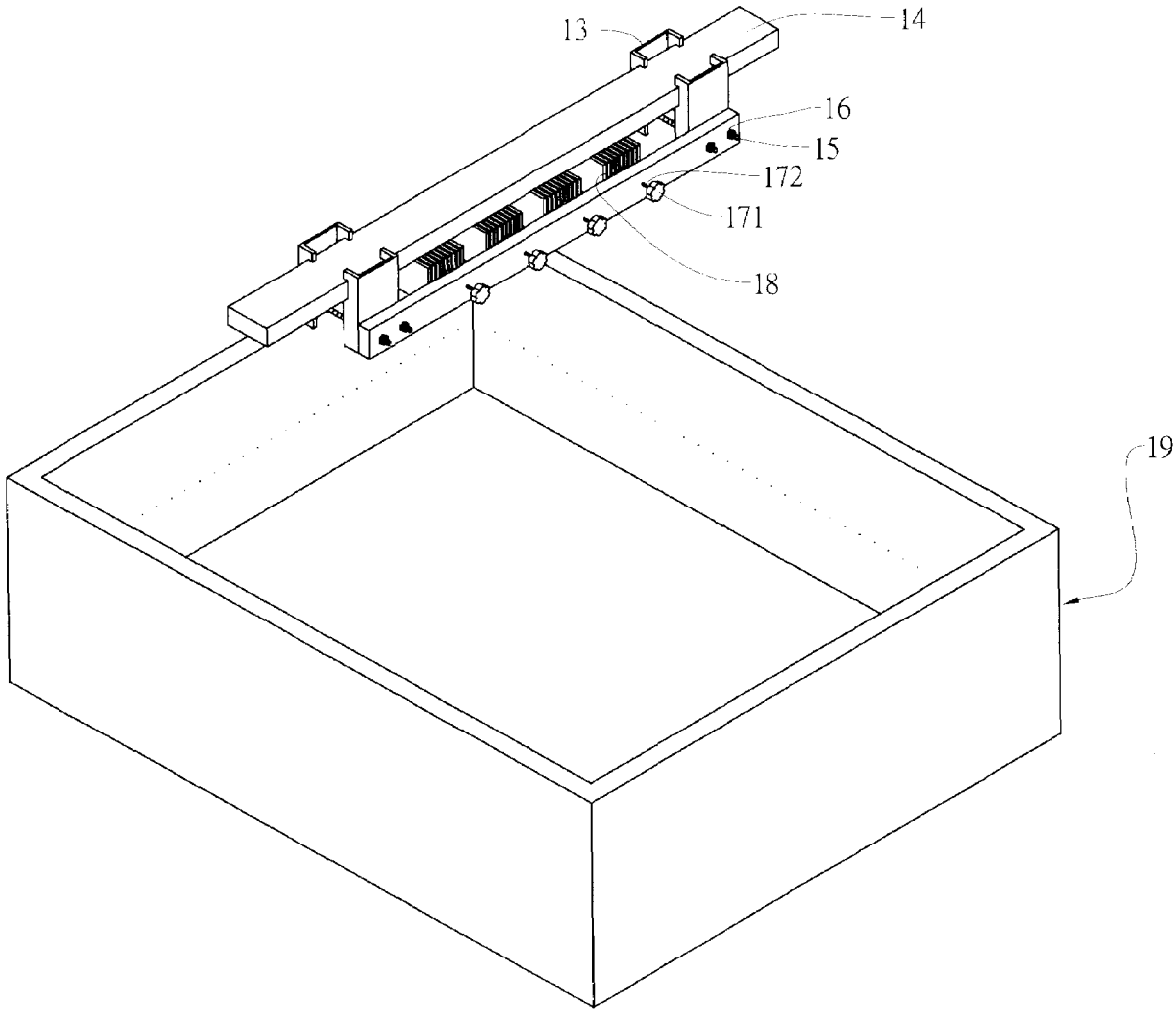
FIG. 4 is a perspective view illustrating the fixture shown in FIG. 3 being ready to be attached to a plating trough.
Figure 5:
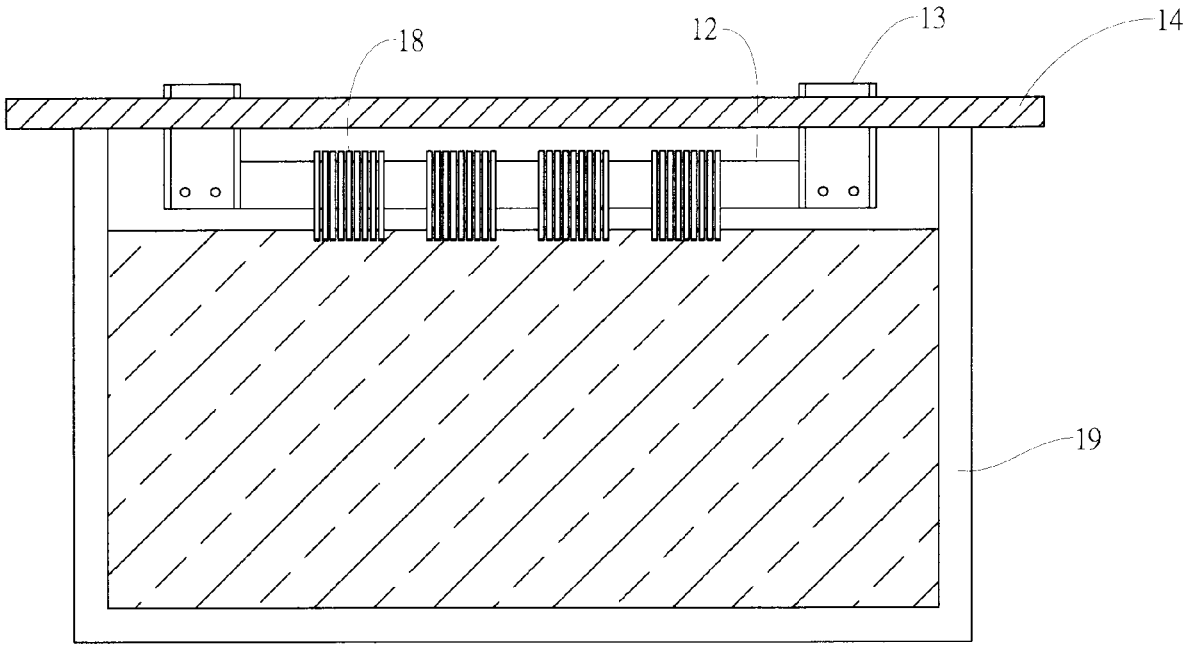
FIG. 5 is a sectional view illustrating the fixture shown in FIG. 3 being attached to the plating trough.

Referring to FIGS. 4 and 5, the fixture is placed at a plating tank 19 with the third main member 14 supported by two opposite sides of the plating tank 19 for the plated zone of the work piece 18 being emerged in the liquid contained in the plating tank 19.

Figure 6:
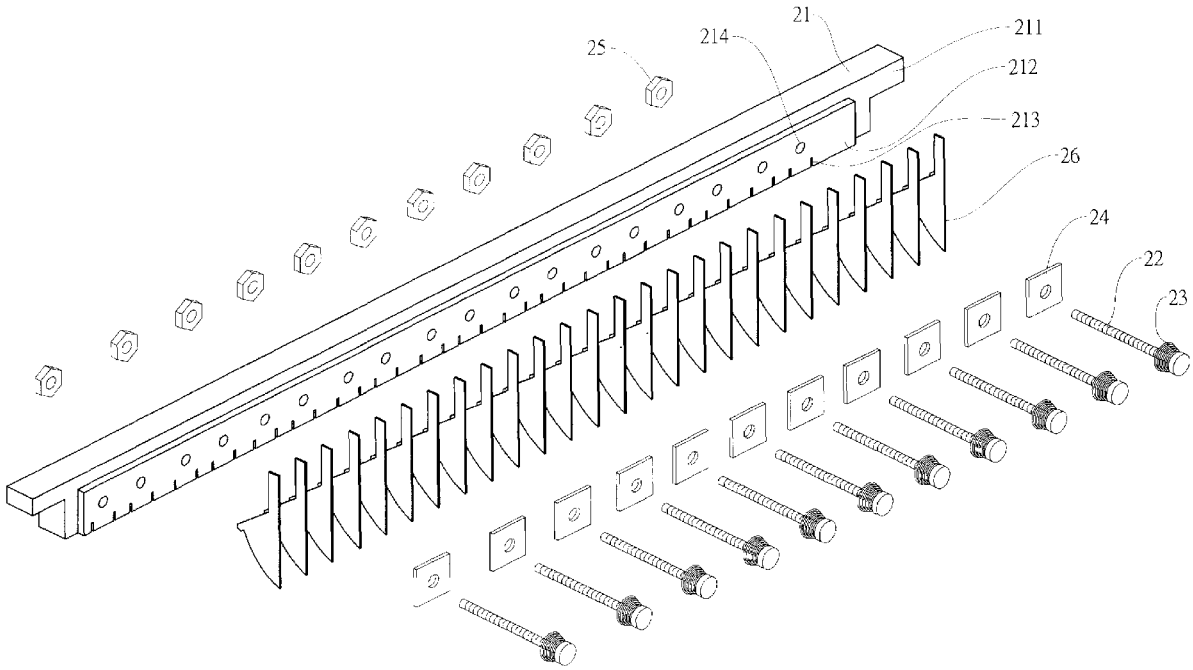
FIG. 6 is an exploded view of an another type fixture employed in a method for a surface being plated locally according to the present invention.
Figure 7:
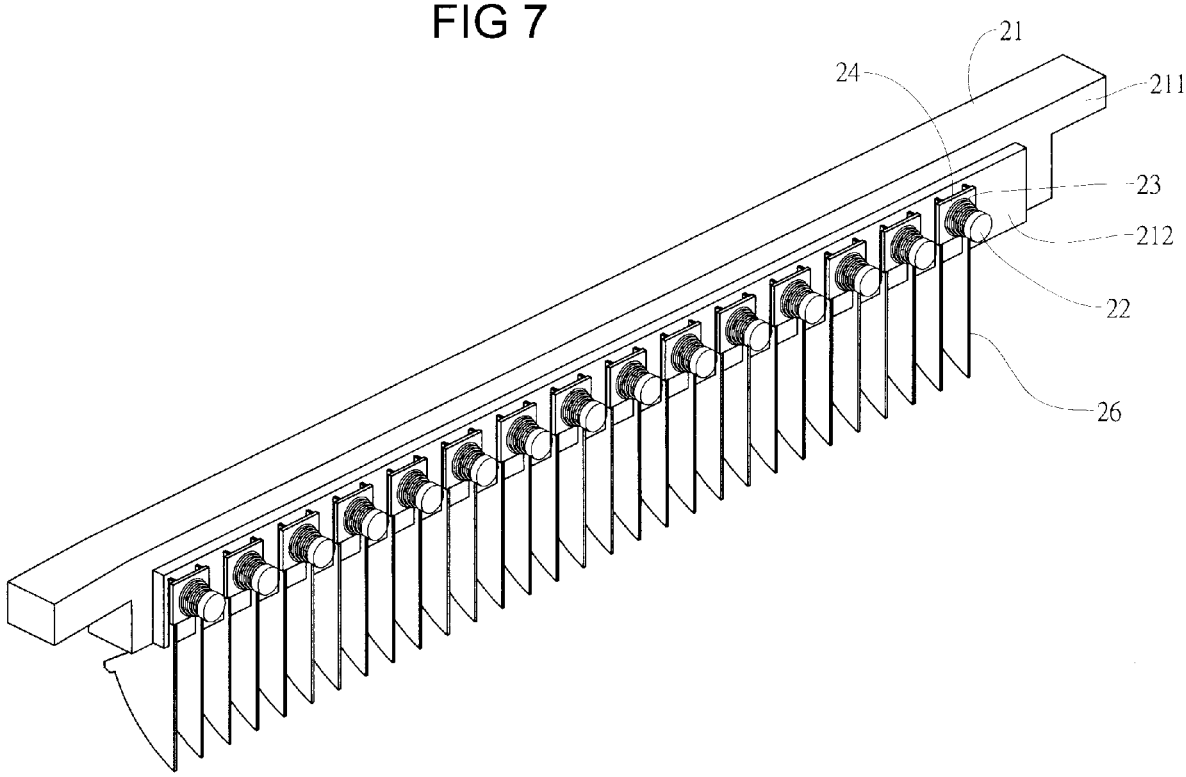
FIG. 7 is an assembled perspective view of the fixture shown in FIG. 6.

Referring to FIGS. 6 and 7, another type fixture is illustrated. The second type fixture includes a main member 21, an arm 211 extending from two ends of the main member 21, a plurality of slits 213 at a lateral side 212 of the main member 21, a plurality of through holes 214 passing through the lateral side 212 and a plurality of threaded connecting elements 22 corresponding to the through holes 214. Each of the threaded connecting elements 22 has a threaded rod part being sleeved with an elastic element 23 and a press plate 24 sequentially. The threaded rod part penetrates through the through holes 214 of the main member 21 from the lateral side with slits 213 and a nut 25 fastens the threaded rod part at a lateral side opposite to the lateral side with slits 213.

At least a work piece 26 such as cooling fin is inserted into the slits 213 individually and the press plate 24 presses the work piece 26 with an elastic urging force of the elastic element 23 once the respective threaded connecting element 22 is fastened with the nut 25. Hence, the work piece 26 is held to the main member 21 temporarily in a way of the plated zone on the surface of the work piece exposes.

Figure 8:
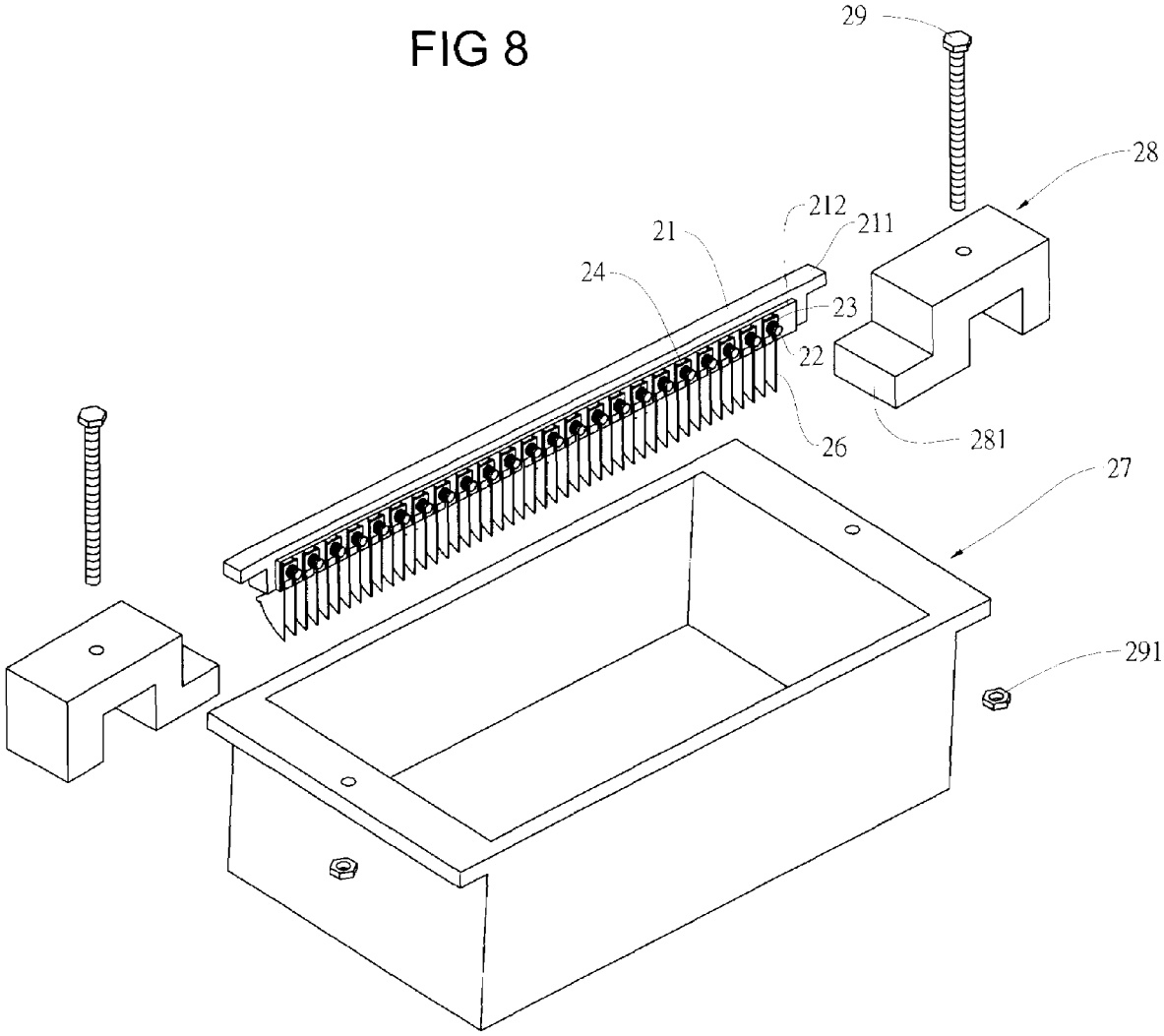
FIG. 8 is a perspective view illustrating the fixture shown in FIG. 7 being ready to be attached to a plating trough.
Figure 9:
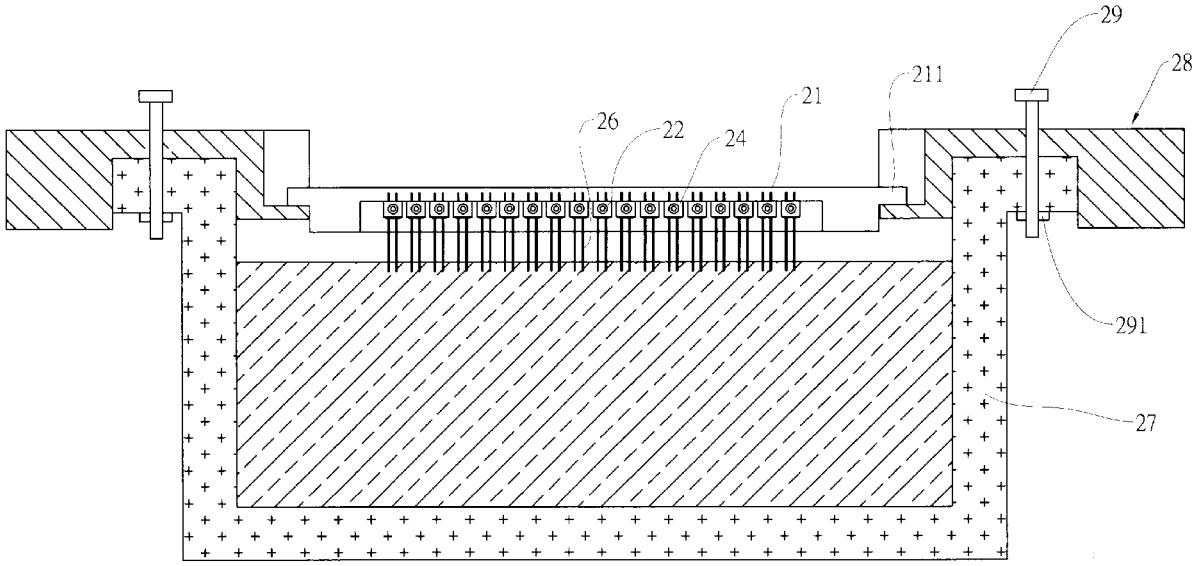
FIG. 9 is a sectional view illustrating the fixture shown in FIG. 7 being attached to the plating trough.

Referring to FIGS. 8 and 9, the preceding fixture is attached to a plating tank 27 and two opposite lateral walls of the plating tank 27 at the top thereof are attached with a support base 28 by means of an adjustable screw 29 passing through the support base 29 and the plating tank 27. The support base 28 has extension part 281 disposed in the plating tank 27 to allow two ends of the main member 21 are supported by the extension part 281 such that the main member 21 is capable of retaining at the top of the plating tank 27 and the plated zone on the surface of the work piece 26 is capable of being immerged into liquid in the plating tank 27.

It is appreciated that advantages of a method for a surface being plated locally according to the present invention is that the method of the present invention is capable of producing a uniform and good looking strip shaped zinc layer and nickel plated surface without wasting zinc solution and nickel solution substantively.

While the invention has been described with referencing to preferred embodiments thereof, it is to be understood that modifications or variations may be easily made without departing from the spirit of this invention, which is defined by the appended claims.

What is claimed is:

1. A method for a surface being plated locally comprising following steps:

(1) repeating twice of operations of removing oil on a surface of at least a work piece and cleaning the surface with water sequentially and then placing the work piece in a de-oxide tank to perform a first de-oxide layer;

(2) a fixture being employed to clamp the work piece and being placed on a first plating tank in a way of two ends of the fixture being supported with two opposite lateral walls of the first plating tank to allow a plated zone on the surface of the work piece to be immerged into a first liquid contained in the first plating tank such that the elated zone on the surface forms a uniform strip shaped de-oxide layer;

(3) then, lifting the fixture with the work piece away the first plating tank and cleaning the work piece with water;

(4) the fixture with the work piece being placed on a second plating tank in a way of the two ends of the fixture being supported with two opposite lateral walls of the second plating tank to allow de-oxide layer on the surface of the work piece to be immerged into a second liquid contained in a second plating tank such that a elated layer is formed to coat the de-oxide layer; and (5) finally, lifting the fixture with work piece away the second plating tank and cleaning the work piece with water and drying the work piece with oven;

wherein the fixture further comprises following parts:

an elongated first main member with a first lateral side and a second lateral side, having at least a threaded hole penetrating the two opposite sides;

an elongated second main member with a third lateral side and a fourth lateral side being disposed corresponding to the first main member, the third lateral side facing the first lateral side;

a channel shaped hanging arm being attached to both ends the first lateral side of the first main member and both ends of the third lateral side of the second main member respectively, the hanging arm at the first main member being opposite to those at the second main member in a way of the inner sides of the hanging arm at the first main member facing the inner sides of the hanging arms at the second main member, and the hanging arm providing a recess at two opposite lateral sides thereof;

an elongated third main member with a fifth lateral side and a sixth lateral side, the fifth lateral side and the sixth lateral side fitting with the recess respectively, and two ends thereof extending outward the first and second main member for being supported with the two opposite lateral walls;

a least a screw rod, penetrating the respective hanging arm, the first main member and the second main member such that both ends of the screw rod extend outward the first and second main member for a space between the two main members being adjusted and set with a nut fastening to both ends of the screw rod; and at least a press element set corresponding to the threaded hole of the first main member, further comprising a threaded stem with a knob, an elastic element and a touch block, the threaded stem adjustably engaging with the threaded hole, the elastic element surrounding the threaded stem and a touch block connecting with a free end of the threaded stem;

whereby, the work piece is held in the space between the main members with the press element set and the plated zone on a surface of the work piece is capable of exposing and being immerged in the first and second liquids respectively.

2. The method for a surface being plated locally as defined in claim 1, wherein the touch lock resiliently presses the work piece by means of an elastic force of the elastic element to avoid hurting the work piece.

3. The method for a surface being plated locally as defined in claim 1, wherein the fixture further comprises following parts:

an elongated main member with a first lateral side and a second lateral side, the first lateral side providing a plurality of through holes;

an arm extending from two ends of the main member;

a plurality of slits being provided at the first lateral side of the main member for being inserted with the work piece;

a plurality of connecting element sets corresponding to the through holes, each of the connecting element set further comprising a threaded rod part sleeved with an elastic component and a press plate sequentially such that the threaded rod part is capable of penetrating the respective the through hole of the lateral side and being fastened to the second lateral side with a nut with the work piece being urged resiliently with the press plate; and a support base being a block with an inverted U shaped recess and an extension part, being disposed at two ends of the main member respectively to be attached to the first and second plating tanks respectively in a way of the inverted U shaped recess fitting with a top of the respective lateral walls of the respective plating tank by means of an adjustable screw passing through the support base and the top and the extension part being disposed in the respective plating tank to support the two ends of the main member;

whereby, the main member is capable of being retained in the respective plating tank in a way of exposing the plated zone on the surface of the work piece for the plated zone being immerged into the respective liquid.

4. The method for a surface being plated locally as defined in claim 3, wherein the respective plating tank has an outward extending rim fitting with the recess.

* * * * *